US005083608A

United States Patent [19]

Abdrakhmanov et al.

[11] Patent Number: 5,083,608

[45] Date of Patent: Jan. 28, 1992

[54] ARRANGEMENT FOR PATCHING OFF TROUBLESOME ZONES IN A WELL

[76] Inventors: Gabdrashit S. Abdrakhmanov, ulitsa Gogolya, 66, kv.71., Bugulma; Rashid A. Uteshev, ulitsa Nagornaya, 23, korpus 2, kv.31., Moscow; Rustam K. Ibatullin, ulitsa Gogolya, 66, kv.49.; Izil G. Jusupov, ulitsa Tukaya, 73a, kv.18., both of Bugulma; Anatoly V. Perov, Varshavskoe shosse, 143, korpus 1, kv.89., Moscow; Albert G. Zainullin, ulitsa Saidasheva, 1, kv.117.; Konstantin V. Meling, both of Bugulma; Boris V. Lavrushko, ulitsa Bolshaya Ochakovskaya, 17, kv.126., Moscow; Ilmas F. Mingazov, ulitsa Vakhitova 4, kv.36., Bugulma; Almaz A. Mukhametshin, ulitsa Gafiatullina, 26, kv.51., Bugulma; Vitaly P. Filippov, ulitsa Gogolya, 47, kv.2., Bugulma; Khalim A. Asfandiyarov, ulitsa Gogolya, 66, kv.65., Bugulma; Tatyana A. Mikhailova, ulitsa Vorovskogo, 58, kv.23., Bugulma; Vladimir S. Parshin, ulitsa Turgeneva, 7, kv.20.; Leonid V. Junyshev, ulitsa Kr.Partizan, 1, kv.18., both of Sverdlovsk; Alexandr A. Puzanov, ulitsa Kalinina, 67, kv.60., Bugulma; Alexandr P. Balandin, pereulok Patatinsky, 3a, kv.90., Permskaya oblast, Krasnokamsk, all of U.S.S.R.

[21] Appl. No.: 555,503

[22] PCT Filed: Nov. 22, 1988

[86] PCT No.: PCT/SU88/00237

§ 371 Date: Aug. 2, 1990

§ 102(e) Date: Aug. 2, 1990

[87] PCT Pub. No.: WO90/05833

PCT Pub. Date: May 31, 1990

[51] Int. Cl.[5] ..... E21B 29/00

[52] U.S. Cl. ..... 166/55; 166/207; 166/242; 166/277

[58] Field of Search ..... 166/55, 277, 242, 243, 166/207

[56] References Cited

U.S. PATENT DOCUMENTS

| | | | |
|---|---|---|---|
| 2,734,580 | 2/1956 | Layne . | |
| 3,364,993 | 1/1968 | Skipper | 166/207 |
| 3,477,506 | 11/1969 | Malone | 166/277 |
| 3,785,193 | 1/1974 | Kinley et al. | 166/277 |
| 4,308,736 | 1/1982 | Lowe | 72/36 |
| 4,830,109 | 5/1989 | Wedel | 166/277 |
| 4,976,322 | 12/1990 | Abdrakhmarov et al. | 166/277 |

FOREIGN PATENT DOCUMENTS

| | | |
|---|---|---|
| 108480 | of 1957 | U.S.S.R. . |
| 199819 | of 1967 | U.S.S.R. . |
| 609870 | of 1978 | U.S.S.R. . |
| 827750 | of 1981 | U.S.S.R. . |
| 976020 | of 1982 | U.S.S.R. . |
| 1411434 | of 1988 | U.S.S.R. . |
| 1424918 | of 1988 | U.S.S.R. . |
| 1493946 | of 1977 | United Kingdom . |

OTHER PUBLICATIONS

M. S. Vinarski, "Sovremennye methody borby s oslozhneniyami pri burenii neftyanykh skvazhin v Tatarii"/-Present-Day Methods of Fighting Troubles in Drilling Oil Wells in the Tartar Republic/, 1959, Tatarskoye Knizhnoye Izdatel'stovo (Kazan) pp. 78-80).

*Primary Examiner*—Terry L. Melius

*Attorney, Agent, or Firm*—Lilling and Lilling

[57] ABSTRACT

The arrangement for patching off troublesome zones in a well has a string of profile pipes with cylindrical portions at their ends, and a device for setting the string of profile pipes in a well, mounted for longitudinal reciprocation inside the string of profile pipes.

Said device includes a reamer of the cylindrical portions of the profile pipes, positioned inside the uppermost cylindrical portion of the string of profile pipes, rigidly connected with an expander positioned above the string of profile pipes and having a housing with expanding elements mounted thereon.

7 Claims, 3 Drawing Sheets

ARRANGEMENT FOR PATCHING OFF TROUBLESOME ZONES IN A WELL

BACKGROUND OF THE INVENTION

1. Field of the Invention

The present invention relates to well-drilling equipment, and more particularly relates to an arrangement for isolating or patching off troublesome zones in a well.

The present invention can be employed to the utmost effect for patching off troublesome zones in the well drilling process, caused by intense loss of circulation of the drilling mud and cement slurry, by inflows of a liquid or gas from an exposed formation and on account of caving-in or crumbling of the rock being drilled.

2. Description of the Related Art

At present, it has become ever more frequently necessary to drill deep wells for oil and gas production, and more often than not a drilling operation encounters formations which are incompatible from the drilling viewpoint, i.e. have abnormally high and low formation pressures. To provide for further drilling of a well, prior to exposing every successive troublesome formation, the previously drilled part of the well is cased-in with a casing string which is subsequently cemented, and the drilling is resumed with bits of a smaller diameter. The more formations encountered which are incompatible to the drilling conditions, the more casing strings are required. Thus, in order to ensure the required inner diameter of the flow string, it is necessary to start drilling at an overly large diameter which incurs a high energy input into the drilling operation, excessive amounts of casings, cement, labor and time, with the penetration rate slowed down and the drilling operation becoming significantly more costly.

There is known an arrangement for patching off troublesome zones in a well, comprising a casing string whose lowermost part is provided with a shoe and the uppermost part is provided with a packer (M. S. Vinarski, "Sovremennye methody borby s oslozhneniyami pri burenii neftyanykh skvazhin v Tatarii"/Present-Day Methods of Fighting Troubles in Drilling Oil Wells in the Tartar Republic/, 1959, Tatarskoye Knizhnoye Izdatel'stvo (Kazan), pp. 78–80).

A drawback of this arrangement is that its setting considerably reduces the hole diameter, involving the necessity of starting a well with bits of an overly large diameter, to be subsequently decreased in successive steps.

Another shortcoming of the known arrangement is the necessity of cementing it in a well, which incurs excessive inputs of time, cement and electric power.

There is further known an arrangement for patching off troublesome zones in wells (SU, A, 907220), comprising a string of profile pipes with cylindrical portions at their ends, the lowermost end carrying a valve shoe, and the uppermost end having an assembly for joining the profile pipe string to the drill pipes.

The major shortcoming of this known arrangement is that it fails to ensure sufficiently reliable isolation of the formation on account of inadequate sealing of the gap between the arrangement and the borehole wall, and of the joints between the profile pipes themselves. Moreover, if areas of caving-in are present above the zone where the arrangement is set, the rock getting into and beyond the arrangement during the additional round trip required for calibrating the patcher impairs the formation closing-off process, thus impairing the reliability of the isolation of the troublesome zone.

Another shortcoming of the known arrangement is much time required for its setting in the well on account of the necessity of performing additional running and pulling operations involved in calibrating the internal passage of the arrangement, which steps up the drilling costs.

It is an object of the present invention to enhance the reliability of patching off troublesome zones in wells.

It is another object of the present invention to cut the time of setting the arrangement in a well.

It is still another object of the present invention to render the process of patching-off troublesome zones in a well less costly.

The present invention has for its object to create an arrangement for patching off troublesome zones in a well, of a structure which ensures setting of a string of profile pipes in the well in a single round-trip cycle, enhancing at the same time the quality of the sealing-off of the isolated troublesome zones.

SUMMARY OF THE INVENTION

This object is attained by an arrangement for patching off troublesome zones in a well, comprising a string of profile pipes with cylindrical portions at their ends, the lowermost end portion carrying a valve shoe, which arrangement, in accordance with the present invention, is provided with a device for setting the profile pipe string in the well, mounted for longitudinal reciprocation inside the string of the profile pipes and including a reamer of the cylindrical portions of the profile pipes, positionable in the uppermost cylindrical portion of the string of the profile pipes and rigidly connected with an expander positionable above the string of the profile pipes and having a housing with expanding members.

The disclosed invention provides for performing the operations of running in the profile pipe string, expanding and calibrating the profile pipes within a single round trip, which simplifies and speeds up the process of patching off troublesome zones in a well and makes it less costly, while multiplying the chances for success of the entire operation in the presence of rock caving-in zones above the formation isolation zone. This is attained owing to the calibration of the profile pipe string being performed right after its reaming by the fluid pressure, with no additional round trips required for individual running-in of the expander. In this situation caved-in rock would not get into the spaces between the hole wall and the profile pipe string, while the internal space of the string is reliably isolated from the annulus, which provides for urging the walls of the profile pipes into tight engagement with the borehole walls and enhances the sealing isolation of the formation.

In a preferred embodiment of the present invention, the arrangement further comprises packers mounted on the end portions of the string of the profile pipes, each packer including a cylindrical pipe length with an annular external groove receiving therein a sealing element, and an internal annular projection corresponding to this groove.

This structure of the disclosed arrangement provides for enhancing the fluid-tightness of the joints of the profile pipes and with respect to the annulus, thus stepping up the reliability of the patching-off of troublesome zones in wells.

It is expedient that the reamer should have an external shoulder adapted to engage the internal annular projection of the cylindrical pipe length of the uppermost packer.

This structural feature of the disclosed arrangement provides for combining its component units into a rational assembly.

It is further expedient that the housing of the expander should have support stages arranged at an angle to the longitudinal geometric axis of the housing and jointly defining a truncated pyramid having its imaginary apex belonging to said axis and facing the tail end of the expander, the supporting stages having the expanding elements mounted thereon.

This steps up the permissible working load of the expanding elements of the expander owing to the reduced load of their bearings, which enhances the operability of the expander and speeds up the operation of calibrating the profile pipe string being set in a formation isolating zone in a well. This, in its turn, steps up the labor productivity in setting the entire arrangement in a well and improves the reliability of the patching-off of a formation.

According to one embodiment of the present invention, each expanding element of the expander is shaped as a truncated spherical segment.

This provides for prolonging the serviceability of the expander by reducing the friction between the expanding elements and the internal wall of the profile pipes in the course of their calibration.

In one embodiment of the present invention, the string of the profile pipes is provided with annular seals received between the matching surfaces of the profile pipes.

This structural features of the disclosed arrangement enhances still further the fluid-tightness of the joints of the profile pipes, and, hence, the reliability of the patching-off of troublesome zones in wells.

It is quite expedient to have at least one packer mounted between the adjacent pipes in the string of the profile pipes.

This version of the disclosed arrangement is intended for cases when the zone to be patched off includes several formations with different formation pressures, to preclude fluid overflows between the formations which may be essential for meeting the ecological standards.

BRIEF DESCRIPTION OF THE DRAWINGS

Other objects and advantages of the present invention will be made apparent in the following description of its embodiment in an arrangement for patching off troublesome zones in a well, with reference being made to the accompanying drawings, wherein.

DESCRIPTION OF THE PREFERRED EMBODIMENT OF THE INVENTION

Figure 1:
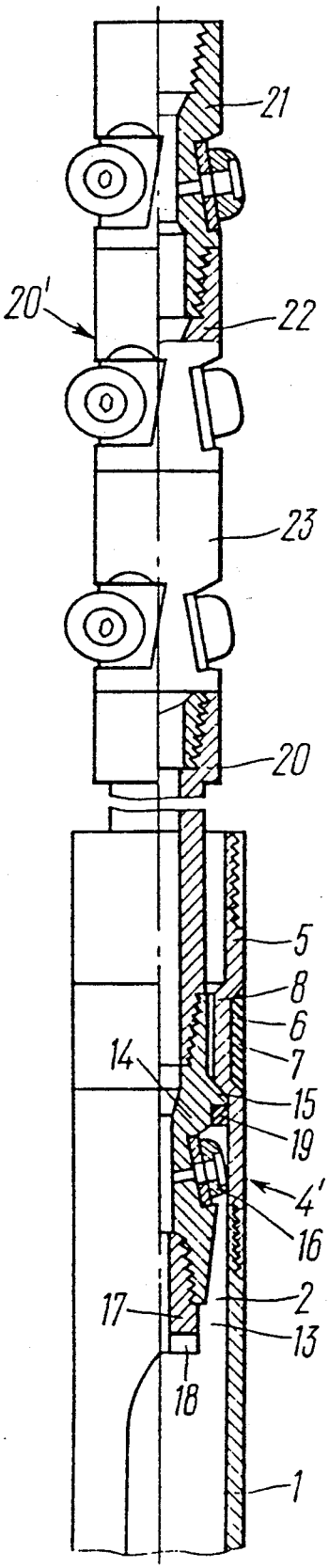
FIG. 1 is the upper part of an arrangement embodying the invention.
Figure 2:
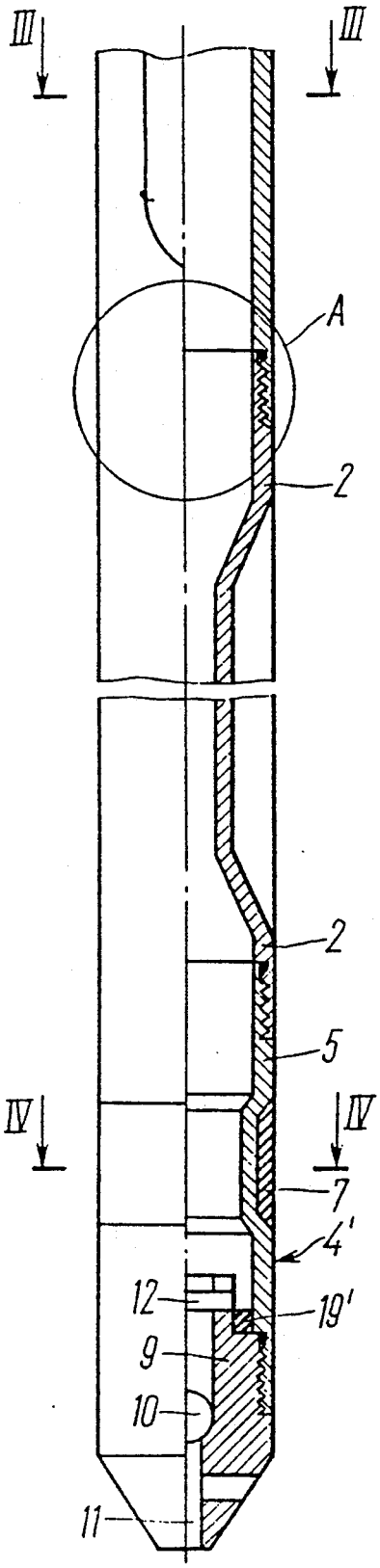
FIG. 2 is the lower part of the arrangement embodying the invention.
Figure 3:
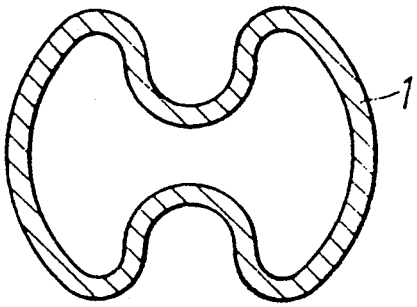
FIG. 3 is a section taken on line III—III of FIG. 2.
Figure 4:
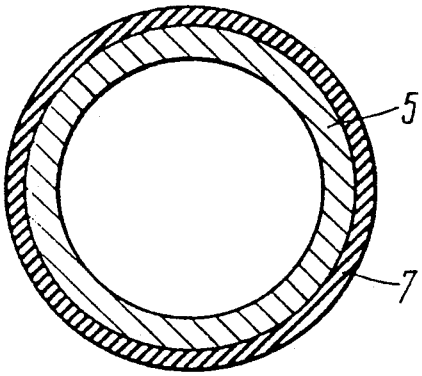
FIG. 4 is section taken on line IV—IV of FIG. 2.
Figure 5:
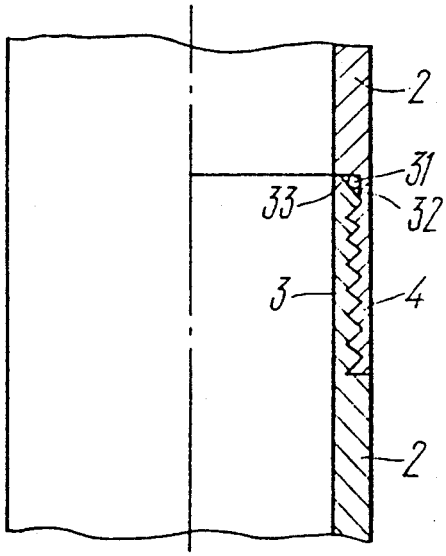
FIG. 5 shows a joint A of FIG. 2.
Figure 6:
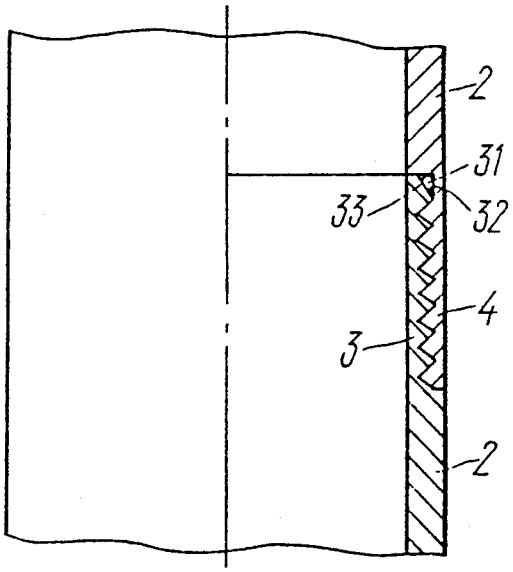
FIG. 6 shows the same joint after the calibration of the profile pipes.

The disclosed arrangement for patching off troublesome zones in a well comprises a string of profile pipes 1 (which may be ultimately a single profile pipe) (FIGS. 1 and 3) provided at their ends with cylindrical portions 2 which are alternatingly provided with external threads 3 and internal threads 4 for joining the pipes 1 to one another and to other components of the disclosed arrangement, as it can be seen in FIGS. 2, 5 and 6. The cylindrical portions 2 of the uppermost and lowermost profile pipes 1 are provided with packers 4' (FIGS. 1, 2, 4), each packer 4' including a cylindrical pipe length 5 with an annular external groove 6 receiving therein a sealing element 7, the internal walls of the pipe lengths 5 having respective annular projections 8 corresponding to the grooves 6.

The lowermost cylindrical portion 2 of the string of the profile pipes 1 accommodates a shoe 9 (FIG. 2) attached to the respective pipe length 5 and provided with a ball-type valve member 10 for closing the flow passage 11, and a lock pin 12 limiting the displacement of the valve member 10 in the shoe 9.

The upper cylindrical portion 2 of the string of the profile pipes 1 (FIG. 1) has an inner space 13 communicating with the inner space of the respective pipe length 5 of the packer 4', accommodating therein a reamer 14 provided with an external annular shoulder 15 adapted to engage the internal annular projection 8 of the pipe length 5, thus supporting the string of the profile pipes 1 in a suspended state. The reamer 14 is provided with reaming elements 16 mounted externally on its central portion, a tip 17 with a slot 18 adapted to engage the lock pin 12 of the shoe 9, and a seal 19 carried by the annular shoulder 15 of the reamer 14. A similar seal 19' is provided in the joint of the shoe 9 with the respective pipe length 5.

Figure 7:
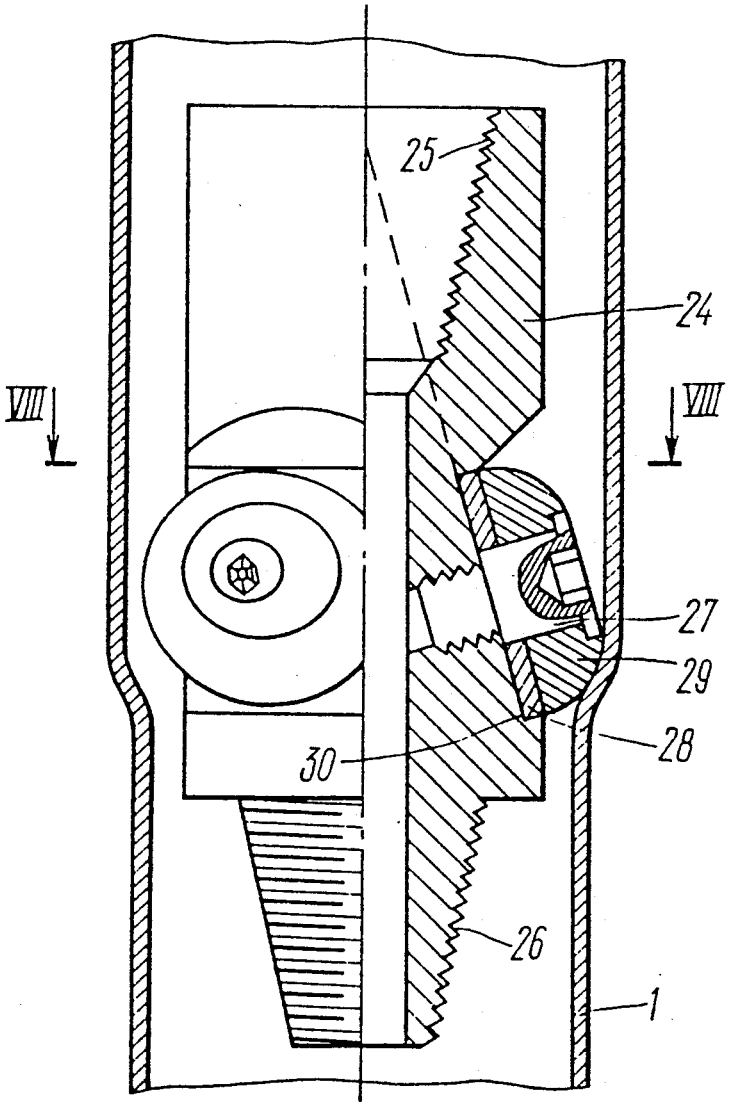
FIG. 7 shows the structure of one section of the expander.
Figure 8:
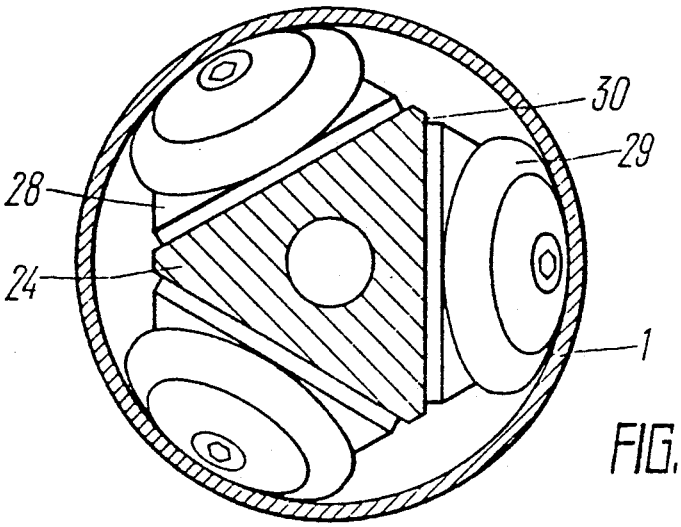
FIG. 8 is a sectional view taken on line VIII—VIII of FIG. 7.

A sub 20 rigidly connects the reamer 14 with an expander 20' including several successively joined sections 21, 22 and 23, each one of them having a housing 24 (FIG. 7) with threads 25 and 26 at its respective ends, its central portion carrying, with the aid of arbors 27 and washers 28 (FIGS. 7 and 8), the expanding elements 29 shaped each as a truncated spherical segment. To accommodate the expanding elements 29, the housing 24 of the expander 20' has made thereon in its central portion a plurality (e.g. three) of supporting stages or flats 30 arranged at an acute angle with respect to its longitudinal geometric axis, and jointly defining a truncated pyramid whose imaginary apex belongs to this longitudinal axis, while facing the tail end 21 of the expander 20'.

The expanding elements 29 of the respective successive sections 21, 22 and 23 of the expander 20' have their respective working diameters diminishing stepwise in the expanding (downward) direction.

The threaded joints 3, 4 (FIGS. 5 and 6) of the profile pipes 1 are provided with annular seals 31 accommodated in a gap defined by an annular groove 32 at the end of the internal thread 4 and a tapering (bevelled) end portion 33 of the external thread 3 of the respective cylindrical portions 2 of the profile pipes 1.

The entire arrangement assembled as illustrated in FIGS. 1 and 2 is attached by the internal thread 25 of the end section 21 of the expander 20' to the lowermost end of the drill pipe string (not shown) and run into the well to a troublesome zone, the pressure of the borehole fluid opening the ball-type valve member 10 with the fluid flowing via the flow passage 11 into the string of the profile pipes 1 and drill pipes (not shown). Then the appropriate fluid is pumped from the surface into the pipe string to build up therein the sufficient pressure (with the ball valve member 10 automatically closing) for straightening the profile pipes 1 and thus for urging them into tight engagement with the wall of the borehole.

Then the drill pipe string (not shown) is rotated with an axial load applied to it to be transmitted to the reamer 14, for its reaming elements 16 to expand the threaded joints 3, 4 (FIGS. 1 and 6) of the profile pipes 1 and also to ultimately straighten them. While performing this, the reaming elements 16 of the reamer 14 press the tapering end 33 of the thread 3 of each respective cylindrical portion 2 of the profile pipe 1 into the annular groove 32 at the end of the inner thread 4 of the respective other cylindrical portion 2 of the matching profile pipe 1, so that the annular seal 31 is deformed to ensure reliable joining and fluid-tight sealing of the adjacent profile pipes 1. At the same time, the inner passage diameter of the cylindrical portions 2 of the profile pipes 1 is increased to provide for unobstructed progress of the annular shoulder 15 of the reamer 14 with its seal 19 through these portions 2.

The subsequent expansion of the passage diameter of the threaded joints 3, 4 of the profile pipes 1, the calibration of their internal diameter and strength-enhancing burnishing of their walls is performed by the successive sections 23, 22 and 21 of the expander 20, which, owing to their working diameters growing in successive steps, consistently expand the inner diameter of the profile pipes 1 to the required value.

As the expander 14 approaches the shoe 9, the slot 18 of its tip 17 engages the lock pin 12 to rotate the shoe 9 and thus to unscrew it from the respective pipe length 5. Thus unscrewed, the shoe falls on the bottom hole, making it possible to ream and expand the lowermost cylindrical end portion 2 of the string of the profile pipes 1 by the reaming elements 16 of the reamer 14 and by the expanding elements 29 of the expander 20'. This ends the job of patching off the troublesome zone with the string of the profile pipes 1, and the drilling operation is continued.

Should the troublesome zone in the well-drilling operation span several formations with different formation pressures, there would arise the necessity of additionally separating (isolating) these formations from one another, to preclude fluid overflows between them. In this case the disclosed arrangement is provided with additional intermediate packers 4' which are set in the string of the profile pipes 1 between those of them that correspond to the intervals to be separated.

By using replaceable reaming elements 16 and expanding elements 29, respectively, in the reamer 14 and expander 20', the disclosed arrangement can be used repeatedly to bring down the drilling operation cost.

The present invention can be employed for patching off troublesome zones in a well-drilling operation, associated with intense losses of the drilling mud and cement slurries, with the inflow of a liquid or gas from an exposed formation, or else with caving-in of the rock being drilled.

We claim:

1. An arrangement for patching off troublesome zones in a well, comprising: a string of profile pipes with cylindrical portions at their ends, the lowermost end portion carrying a shoe with a valve; and a device for setting the string of profile pipes in the well, mounted for longitudinal reciprocation inside the string of profile pipes and including a reamer of the cylindrical portions of the profile pipes, positioned in an uppermost cylindrical portion of the string of profile pipes, and rigidly connected with an expander positioned above the string of profile pipes and comprising a housing with expanding members.

2. An arrangement according to claim 1, further comprising packers mounted on the end portions of the string of profile pipes, each packer comprising a cylindrical pipe length with an annular external groove receiving therein a sealing element, and an internal annular projection corresponding to said groove.

3. An arrangement according to claims 1 or 2, wherein the reamer has an external shoulder adapted to engage the internal annular projection of the cylindrical pipe length of the uppermost packer.

4. An arrangement according to claim 1, wherein the housing of the expander has support stages arranged at an angle to the longitudinal geometric axis of the housing and jointly defining a truncated pyramid having an apex belonging to said axis, and facing the tail end of the expander, the supporting stages having the expanding members mounted thereon.

5. An arrangement as claimed in claims 1 or 4, wherein each expanding element of the expander is shaped as a truncated spherical segment.

6. An arrangement according to claim 1, wherein the string of profile pipes is provided with annular seals received between matching surfaces of the profile pipes.

7. An arrangement according to claim 2, further comprising at least one additional packer mounted between adjacent pipes in the string of profile pipes.

* * * * *